US008323040B2

(12) United States Patent
Prest

(10) Patent No.: US 8,323,040 B2
(45) Date of Patent: Dec. 4, 2012

(54) DOCKING STATION WITH MOVEABLE CONNECTOR FOR HAND-HELD ELECTRONIC DEVICE

(75) Inventor: Chris Prest, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 899 days.

(21) Appl. No.: 12/205,801

(22) Filed: Sep. 5, 2008

(65) Prior Publication Data

US 2010/0062615 A1 Mar. 11, 2010

(51) Int. Cl.
*H01R 13/60* (2006.01)

(52) U.S. Cl. ..... 439/131; 439/165

(58) Field of Classification Search ..... 439/131, 439/341, 165, 142; 361/679.01, 679.41–478.44
See application file for complete search history.

(56) References Cited

U.S. PATENT DOCUMENTS

| | | | | |
|---|---|---|---|---|
| 5,144,290 | A * | 9/1992 | Honda et al. | 345/156 |
| 5,230,016 | A * | 7/1993 | Yasuda | 455/573 |
| 5,535,093 | A | 7/1996 | Noguchi et al. | |
| 5,686,810 | A * | 11/1997 | Yasui | 320/113 |
| 6,203,363 | B1 | 3/2001 | Yanaura | |
| 6,315,582 | B1 * | 11/2001 | Nishio et al. | 439/131 |
| 6,438,229 | B1 * | 8/2002 | Overy et al. | 379/446 |
| 6,898,080 | B2 | 5/2005 | Yin et al. | |
| 6,926,130 | B2 | 8/2005 | Skowronski | |
| 7,014,486 | B1 | 3/2006 | Wu | |
| 7,352,567 | B2 | 4/2008 | Hotelling et al. | |
| 7,503,011 | B2 * | 3/2009 | Wilkinson et al. | 715/765 |
| 7,511,954 | B2 * | 3/2009 | Tsai et al. | 361/679.41 |
| 7,538,792 | B2 * | 5/2009 | Takahashi | 348/207.1 |
| 2004/0109722 | A1 | 6/2004 | Huang | |
| 2004/0224638 | A1 | 11/2004 | Fadell et al. | |
| 2005/0265569 | A1 | 12/2005 | Langberg et al. | |
| 2006/0061958 | A1 | 3/2006 | Soloman et al. | |
| 2006/0250764 | A1 | 11/2006 | Howarth et al. | |
| 2006/0274910 | A1 | 12/2006 | Schul et al. | |

(Continued)

FOREIGN PATENT DOCUMENTS

GB 2127235 A 4/1984

(Continued)

OTHER PUBLICATIONS

U.S. Appl. No. 12/652,018, filed Jan. 4, 2010 (Hayashida et al.).

(Continued)

*Primary Examiner* — Xuong Chung Trans
(74) *Attorney, Agent, or Firm* — Kilpatrick Townsend & Stockton LLP

(57) ABSTRACT

A dock includes a moveable connector to allow connection to a handheld electronic device. Generally, the connector moves between a closed position and an open position where the connector is placed in at least one substantially upright position for receiving a handheld electronic device. The connector may be hidden from view or lie flush relative to the body of the dock, thereby making the dock more portable and easily organized with other objects, e.g. in stacking. Various motions can be used to move the connector. Examples include one or more rotations, translations, and/or the like. Various retention mechanisms may be employed to retain the connector in an open position when connected to the media player. Also, various electrical mechanisms can be used to couple the movable connector to a fixed printed circuit board (PCB) contained inside the body of the dock.

16 Claims, 10 Drawing Sheets

U.S. PATENT DOCUMENTS

| | | | |
|---|---|---|---|
| 2006/0285710 | A1 | 12/2006 | DeVesto |
| 2007/0073952 | A1 | 3/2007 | Tsai et al. |
| 2007/0230723 | A1 | 10/2007 | Hobson et al. |
| 2007/0273327 | A1 | 11/2007 | Daniel et al. |
| 2008/0259550 | A1 | 10/2008 | Lien |
| 2009/0009957 | A1 | 1/2009 | Crooijmans et al. |

FOREIGN PATENT DOCUMENTS

| | | | |
|---|---|---|---|
| GB | 2351187 | A | 12/2000 |
| GB | 2433845 | A | 7/2007 |
| WO | WO 2005/047052 | A | 5/2005 |
| WO | WO 2008/061040 | A2 | 5/2008 |
| WO | WO 2009/024749 | A1 | 2/2009 |

OTHER PUBLICATIONS

International Search Report from related PCT/US2010/061577, dated Apr. 28, 2011 (10 pages).

* cited by examiner

DOCKING STATION WITH MOVEABLE CONNECTOR FOR HAND-HELD ELECTRONIC DEVICE

BACKGROUND

The present invention relates to apparatus and methods for a docking station for a media player. More particularly, the present invention relates to a docking station having a rotatable connector.

Media players allow consumers to listen to music, look at pictures, and/or watch videos. These media players are typically hand-held, thus allowing portability. When people are mobile, the consumer holds the media player in one's hand or in a pocket. However, holding the media player in one's hand can be tiresome, and holding the media player in one's pocket may prevent some functionality of the media player from being accessed, e.g., watching a video.

Additionally, people often use a media player when they are at home or at some other stationary location. When stationary, docking stations are available for connecting the media player, e.g., to a sound system. In this manner, songs on the media player may be listed to as one resides in the same room, but without having to use headphones.

The docking stations available today have a stationary connector that sits at a fixed angle and that sticks out of a depression in the docking station. Such fixed connectors limit the usefulness of the docking stations, particularly if such docking stations are desired to be portable. Furthermore, the depression is often sized and dimensions for a specific device and thus docking stations may be limited to a specific device.

Therefore, it is desirable to have a docking station with a more functional connector.

BRIEF SUMMARY

Embodiments relate to a dock (also called a docking station) that includes a connector that moves out of the body of the dock in order to allow connection to a handheld electronic device (e.g., an iPod® or an iPhone®). Generally, the moveable connector moves between a first position (e.g. a closed position) to a second position (e.g. an open position) where the connector is designed to interface with the handheld electronic device. For example, the connector may be placed in at least one substantially upright position relative to the body such that it can properly receive a handheld electronic device.

In the first position, the connector may be hidden from view, or one or more of its surfaces may lie flush relative to the body of the dock (thereby improving functionality when the dock is being transported since the connector is not protruding). Various motions can be used to move the connector including but not limited to rotations, translations, flexing, and/or the like. Various retention mechanisms can be used to secure and position the connector in its closed and/or open position(s).

According to one exemplary embodiment, a docking station for receiving a hand-held electronic device has a housing and a connector bay. A connector assembly is adapted to reside in the connector bay and is adapted to connect to the receptacle connector of the hand-held electronic device. The connector assembly includes a connector plug that connects with a receptacle connector of the hand-held electronic device. A pivot mechanism is coupled with the connector plug and is configured to rotate the connector plug between a closed position and one or more open positions. When in an open position, the connector plug is configured to connect to the receptacle connector. When in a closed position, a side of the connector plug is substantially flush or below a top surface of the housing. A retention mechanism is coupled with the pivot mechanism and is adapted to hold the connector plug in an open position when connected with the hand-held electronic device. Also, a circuit board electrically is coupled with the electrical contacts of the connector plug.

According to another exemplary embodiment, a docking station for receiving a hand-held electronic device has a housing and a connector bay. A connector assembly is adapted to reside in the connector bay and is adapted to connect to the receptacle connector of the hand-held electronic device. The connector assembly includes a connector plug that connects with a receptacle connector of the hand-held electronic device. A pivot mechanism is coupled with the connector plug and is configured to rotate the connector plug between a closed position and a plurality of open positions. When in an open position, the connector plug is configured to connect to the receptacle connector. When in the closed position, a side of the connector plug is substantially flush or below a top surface of the housing. A releasable locking mechanism is associated with each open position and holds the connector plug in a respective open position when the locking mechanism is in an unreleased state.

According to another exemplary embodiment, a docking station for receiving a hand-held electronic device has a housing and a connector bay. A connector assembly is adapted to reside in the connector bay and includes a connector plug adapted to connect to the receptacle connector of the hand-held electronic device. The connector plug is movable between a closed position in which the connector plug is entirely disposed within the connector bay and at least one open position in which an end of the connector plug is exposed for coupling with the receptacle connector. A first force profile for moving the connector plug from an open position to the closed position includes an increase in the force profile.

According to another exemplary embodiment, a docking station for receiving a handheld electronic device includes one or more electronic circuits and a body that encloses the electronic circuits. A moveable connector has one or more contacts that are electrically coupled with the electronic circuits and is adapted to connect to a corresponding connector of the hand-held electronic device. The moveable connector moves from a first position in the body to at least one second position out of the body. When in the first position, the moveable connector is incapable of electrically connecting with the handheld electronic device. When in the second position, the moveable connector is capable of electrically connecting with the handheld electronic device.

A better understanding of the nature and advantages of the present invention may be gained with reference to the following detailed description and the accompanying drawings.

DETAILED DESCRIPTION

The invention pertains to a docking station or dock that provides a more functional connector assembly. For example, a connector on the dock may be configured to move out of a body or housing of the dock in order to allow connection to a handheld electronic device. This may be accomplished by moving the connector from a closed position to at least one open position where the connector rises above and thus out of the body. Various movement mechanisms may be employed to move the connector between positions (e.g., pivot, sliding, and/or flexing mechanisms). Various retention mechanisms may be employed to retain the connector in an open position when connected to the hand held electronic device (e.g., detents, ratchets, friction couplings, cams, linkages, latches, locks, snaps, buttons, sliders, springs, or the like, and any combinations thereof). Also, various electrical mechanisms can be used to operatively couple the movable connector to internal electronics such as a fixed printed circuit board (PCB) contained inside the body of the dock (e.g., swiping contacts, wires, flex circuits, etc.).

For purposes of discussion, a hand-held electronic device is of such size and proportion that it may be held in the hand of a person (thus highly portable). Note that the handheld electronic device does not need to be fully enclosed in that person's hand. Thus, any handheld electronic device that may be held, grabbed, or otherwise controlled with a hand of a person is a hand-held handheld electronic device. Examples of hand held electronic devices include but are not limited to media players that play or otherwise transmit audio and/or visual (video or picture) signals (e.g., iPod) and phones that allow users to communicate remotely through wireless connections. Hand held electronic devices may also correspond to mini-computers, PDAs, internet or email based devices. In fact, hand held electronic devices may be a combination of specific or dedicated devices mentioned above (e.g., Smart phone such as the iPhone)

Embodiments of the invention are discussed below with reference to FIGS. 1-9. However, those skilled in the art will readily appreciate that the detailed description given herein with respect to these figures is for explanatory purposes as the invention extends beyond these limited embodiments.

Figure 1A:
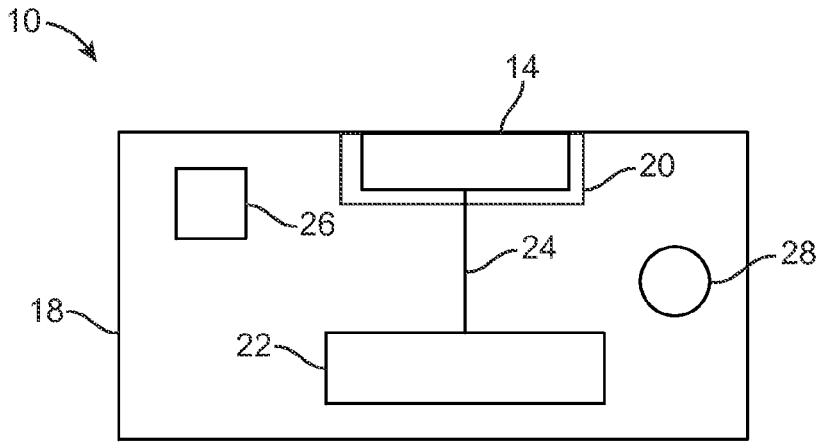
FIGS. 1A and 1B are simplified diagrams of a docking station 10 in accordance with one embodiment of the present invention.
Figure 1B:
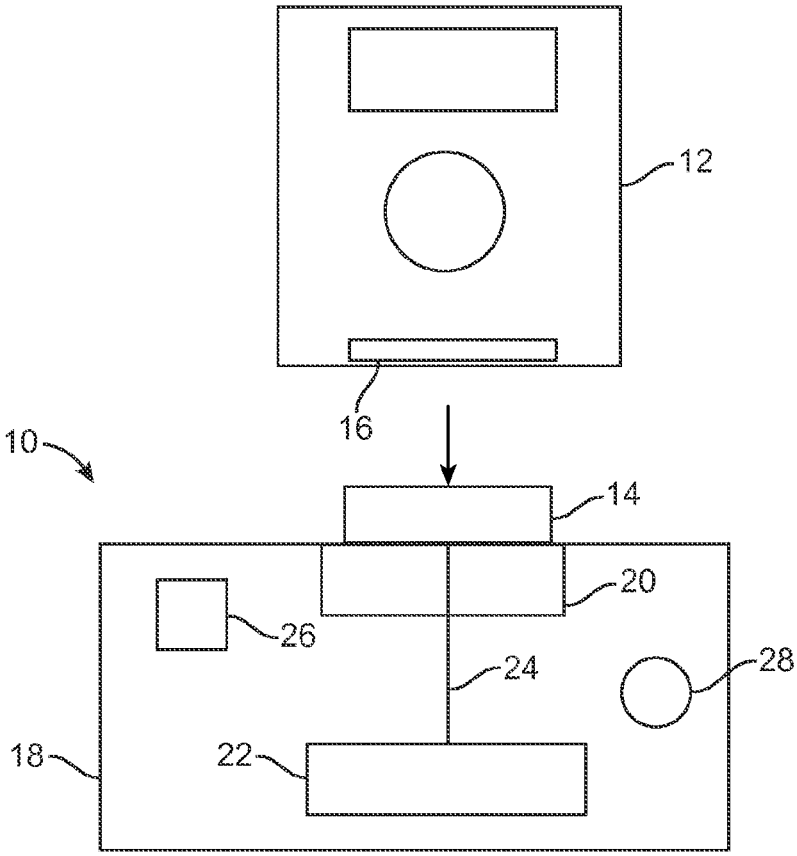

FIGS. 1A and 1B are simplified diagrams of a docking station 10 in accordance with one embodiment of the present invention. The docking station 10 provides a platform for quickly and easily coupling a hand held electronic device 12 to another system or device as for example a computer, a power source, or peripheral devices such as a monitor, a keyboard, speakers, etc. The handheld device 12 may for example include media players, cellular phones, internet/email devices, PDAs, and the like. Examples of handheld electronic devices may be any of those iPhones or iPods manufactured by Apple Inc. of Cupertino Calif.

The docking station 10 may be a stand alone unit that communicates with other devices or systems through wired (e.g., cables) or wireless (e.g., Bluetooth) connections, or alternatively, the docking station 10 may be integrated directly into the other devices or systems. In one particular embodiment, the docking station 10 is a portable stand alone unit. In on example, it may be sized for carrying in a user's pocket.

In order to provide communications to other devices or systems, the docking station 10 also includes a connector 14 that engages a corresponding connector 16 on the handheld electronic device thereby providing data and/or power communications therebetween. In the case of a stand alone unit, the connector 14 may be coupled to other connectors, ports, jacks transceivers or cables of the docking station thereby providing external connections to the other devices or systems. In the case of an integrated docking station, the connector 14 may be wired directly to the components of the host device or system. In some cases, the connector is substantially on its own while in other cases the connector may be part of a module that includes a secondary structure, such as a housing.

The connector 14 may be widely varied. It may generally correspond to USB, Firewire, or other standardized connector formats. In one example, the connector 14 is a 30 pin connector as described in U.S. patent application Ser. No. 10/423,490 entitled "Media Player System" by Fadell et al, which is incorporated by reference in its entirety. In one embodiment, the hand-held electronic device has a female connector receptacle that connects with a male connector plug of the dock. In alternate embodiments, the hand-held electronic device has a male connector receptacle that connects with a female connector plug of the dock. In this embodiment, the female receptacle may be situated in a housing.

In accordance with one embodiment, the connector 14 is configured to move relative to a body 18 of the docking station 10. The connector may for example be configured to translate, rotate, flex, and the like relative to any surface of the body of the docking station (e.g., side, top, bottom, front, back). The movement is generally provided to extend the connector 14 away from the body such that the connector 14 can properly engage the corresponding connector 16. For example, the connector 14 may move between a closed position and one or more open positions for engaging the corresponding connector 16. In one embodiment, the corresponding connector 16 is incapable of engaging the connector 14 in the closed position.

In one example, the connector translates between closed and open positions. For example, it may slide relative to the body. In another example, the connector rotates between closed and open positions. For example, it may pivot around an axis. In yet another example, the connector may flex between closed and open positions. For example, it may include a flexure that allows a bending action. In some cases, the connector movement may be a combination of different movements such as for example translate and rotate.

The closed position (as shown in FIG. 1A) may place the connector 14 at least partially within the confines of the body and in some cases entirely within the confines of the body (as shown). The connector 14 may be housed in a recess or void or cavity 20 in the body 18 when the connector 14 is in the closed position. In some cases, the arrangement may provide a substantially flush surface on the side of the body 18 where the connector is located when the connector 14 is in the closed position. This may be beneficial in portable docking stations (reduces or substantially eliminates protrusions that can get caught on objects such as a pocket and that are aesthetical unpleasing). In addition, in some arrangements, the connector 14 may even be hidden from view giving the device a more pleasing aesthetical appearance (the body has a more uniform look).

The open position (as shown in FIG. 1B), on the other hand, places the connector 14 away from the body 18 of the docking station 10. That is, the connector 14 extends outwardly from the surface of the body 18 where the connector 14 is located. This may be beneficial in that the connector 14 is completely exposed outside of the body, and thus any handheld device that includes a corresponding connector can couple with the docking station. Although the term open position may be a single position, in some cases, it may refer to a plurality of open positions. For example, the connector may have multiple open positions that place the connector at different orientations/locations/distance away from the body. These positions may be at a number of designated points or placed at any point between two end points.

The moving connector 14 may be connected to other electronics 22 housed within the body 18 via a flexible or movable enabled connection 24 such as swiping contacts, wires, traces, flexible circuits and/or the like. Some of these examples may include slack so that the connector can move between positions. The electronics 22 may be widely varied. The electronics may for example include circuit boards, controllers, connectors, and the like. In most cases, the electronics are fixed within the body. However, in some situations some may also be configured to be movable to help manage the connection between the electronics and the connector. For example, a printed circuit board may slide along rails. Certain embodiments are described in more detail below.

The docking station 10 may also include a retention/release mechanism 26. The retention/release mechanism 26 may be configured to hold the connector in the first position and release the connector when it is desired to be used. The mechanism 26 may for example include a spring that continuously biases the connector 14 outwardly and a lock that holds it against the bias force until it is released. The lock may for example be released via a button positioned on one of the surfaces of the body 18. Once released, the connector 14 may be repositioned within the body by simply forcing the connector 14 back into the body against the spring force until the lock reengages the connector.

Actuation buttons 28 may be provided that enable the connector 14 to be moved when the button 28 is actuated by the user. The connector 14 may be spring-biased to help urge the connector to one or more or its positions. In one embodiment, a cam based horizontal translation may be used. In one embodiment, a ratchet slide mechanism may be used. In one embodiment, a cam detent may be used to hold positions of connector.

In one particular embodiment, the connector 14 is configured to at least rotate relative to the body 18. A rotatable connector 14 allows the dock thinner, more portable, and protects the connector against damage when the dock is being transported. The connector may rotate about a pivot mechanism that links the connector and body together. This pivot mechanism may be any assembly that allows the connector to rotate, e.g., about an axis that is part of the pivot mechanism. The connector and pivot mechanism may be formed into a single integral unit. The amount of rotation that is provided may be widely varied and generally depends on the desired orientation of the handheld electronic device when it is docked.

The amount of rotation is generally set to place the handheld electronic device in a substantially upright position (therefore exposing its UI). The amount of rotation may for example be between 90 and 135 degrees and more specifically about 105 degrees relative to the closed position. In one embodiment, the rotation is at least greater than 90 degrees to ensure proper force balance (e.g., 105 degrees). In some embodiments, the dock is configured such that a force profile required to rotate the connector from an open position to a closed position includes an increase in the force profile. Moreover, in some embodiments, the connector is also configured to translate such that the connector slides out and rotates about a pivot. Certain embodiments are described in more detail below.

Figure 2A:
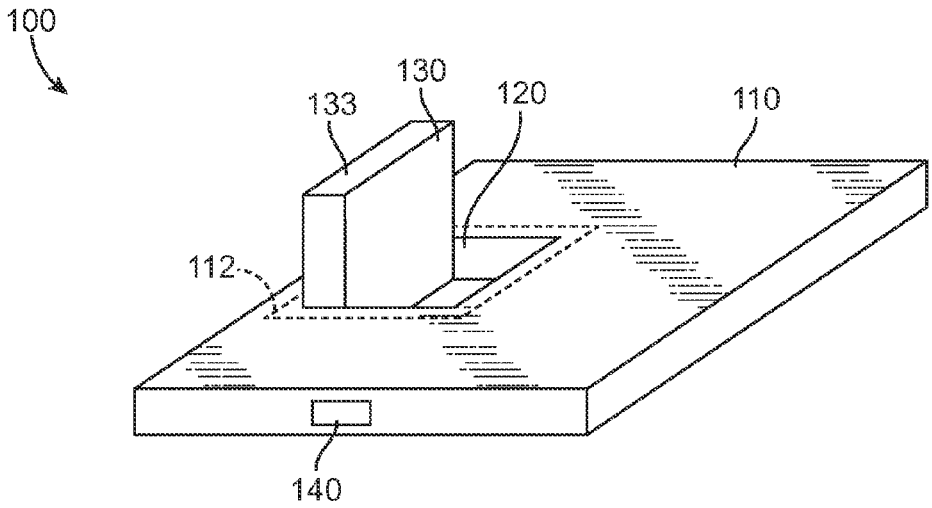
FIGS. 2A and 2B show a portable docking station 100 for receiving a hand-held electronic device (such as a media player) according to an embodiment of the present invention.
Figure 2B:
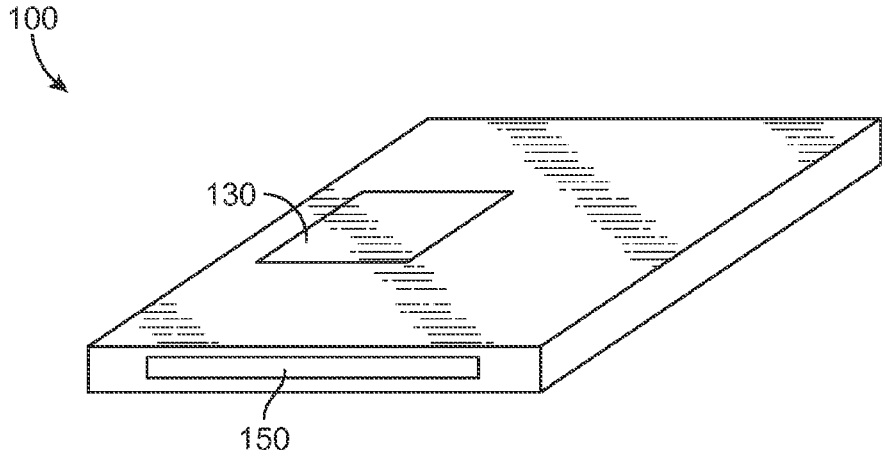

FIGS. 2A and 2B show a portable docking station 100 for receiving a hand-held electronic device (such as a media player) according to an embodiment of the present invention. The portable docking station 100 may generally correspond to the docking station shown in FIG. 1.

As shown, the docking station 100 includes a housing 110, which may be made of any suitable material, e.g., plastic and/or metal. The housing 110 is configured to enclose various internal components of the docking station 100 including various electronics and possibly a ballast for stabilizing the docking station. The shape of the housing, which can help define the ornamental appearance of the docking station, may be widely varied. It may for example include rectilinear and/or curvilinear shapes.

In general, the housing 110 is configured to support a handheld device thereon and thus provide a substantial base to keep it from rocking or falling over. In the example shown, the housing extends substantially longitudinally. It may for example, have a low profile height, a width that is greater than its height, and a length that is greater than its width. Further, it may have a flat bottom portion(s) that can easily rest on a flat surface such as a desk. Although a specific shape is shown, it should be appreciated that the housing may be larger, have different shapes, and have a different orientation with respect to any of its features.

The docking station 100 includes a mating region 112 adapted to receive and support the hand-held electronic device in its desired position relative to the housing 110 (Both mechanically and electronically). The mating region 112 may be widely varied. The mating region 112 may be applied to any surface of the housing. In the illustrated embodiment, the mating region 112 is situated at a top surface of the housing 110.

The mating region 112 may include at least a movable connector 130 that is adapted to connect to a corresponding connector of the hand-held electronic device. The moveable connector 130 may be equivalent to or part of a moveable connector assembly. The moveable connector (or connector assembly) 130 may provide all or some of the physical support of the mated handheld electronic device. In one example, the connector 130 is a male plug connector that fits into the female receptacle connector on the handheld electronic device.

The movement of the movable connector 130 may be widely varied. In the illustrated embodiment, the moveable connector 130 is configured to rotate relative to the housing 110 between a closed position where it lies substantially parallel with the top surface of the housing 110 (such that the electronic device cannot mate therewith) and one or more open positions where it extends up and outwardly from the top surface of the housing 110 (such that the electronic device can mate therewith). In essence, when in the open position, the moveable connector 130 becomes a protruding member for engaging the corresponding connector of the handheld electronic device; and when in the closed position, the moveable connector 130 becomes a surface member, which may be made to be incapable of being engaged by the corresponding connector of the handheld electronic device. In one embodiment, the connector 130 may lie adjacent on the top surface of the housing 110 when in the closed position. In another embodiment, as shown, the connector 130 may reside within a connector bay 120 formed within the top surface of the housing 110.

Referring to this embodiment specifically, many different configurations of the connector bay 120 and the connector 130 are possible. For example, the connector 130 may rotate from any side of the connector bay 120. Furthermore, the shape and dimensions of the connector bay 120 may be widely varied relative to the shape and dimensions of the connector. Generally speaking, the connector bay has an outer peripheral shape and dimension that are larger than that of the connector 130 (such that the connector can reside therein). For many reasons, it may be desirable to reduce gaps found between the connector and the sides of the connector bay while still allowing rotation therefrom (e.g., aesthetics, dust prevention).

In one embodiment, the connector bay 120 may be of substantially the same width as the end of the connector 130. Additionally or alternatively, the connector bay 120 may be of substantially the same length as the side of the connector 130. Also for many reasons, it may be desirable to place one of the surfaces of the connector substantially flush with the top surface of the housing (e.g., aesthetics, prevent jagged edges). Thus, the connector bay 120 may be of substantially the same height as the thickness of the connector 130. Alternatively, the height of the connector bay may be larger than the thickness of the connector, but include a stop that places the outer surface in the closed position level or flush with the top surface of the housing. In either case, the docking station has substantially uniformly continuous top surface when the connector is in a closed position (e.g., flat). In one aspect, when the connector is hidden or flush, a surface of the housing may be advantageously used to set objects as the surface is relatively flat (i.e. no connector protruding).

Generally, in one embodiment, the shape and dimension of the connector bay may be made similar to the shape and dimension of the connector. Put another way, the outer peripheral form of the connector bay may generally coincide with the outer peripheral form of the connector. It should be appreciated, however, that because the connector moves, some tolerance gaps may need to be provided about its sides. Moreover, it should be appreciated that in some cases the connector may not be flush but rather recessed or resting above the plane of the top surface of the housing.

In order to create a flush appearance, in one embodiment, the exposed side of the connector in the closed position and the top surface of the housing have a shape that matches each other contour whether rectilinear (flat) or curvilinear (rounded) while still allowing the connector to mate with the corresponding connector of the handheld electronic device.

In one embodiment, the connector 130 includes an engagement end 133 and an attachment end opposite the engagement end. The engagement end 133 receives and mates with the corresponding connector of the handheld electronic device. The attachment end is the location where the connector includes an interface for operatively coupling with electronics inside the docking station. The connector also includes a pivot mechanism that provides a rotating functionality, thereby providing a rotatable connector assembly. The pivot mechanism is configured to rotate the connector 130 between the closed position and one or more open positions. The pivot mechanism may be situated between the engagement end and the attachment end. However, in order to keep the connector bay low profile (thin), the pivot mechanism may be located closer to and more likely proximate the attachment end (e.g., the connector bay does not have to compensate for a swinging attachment end). In some cases, the pivot mechanism may utilize a portion of the connector. For example, the connector may include openings that receive pivot pins situated on the side walls of the connector bay, or alternatively, the connector may include pins that engage openings in the side walls of the connector bay. Alternatively, the pivot mechanism may also be provided by a frame that is attached to the connector (e.g., connector assembly).

The connector 130 may be widely varied. It may include a series of spatially separated contacts (e.g. at end 133), which can be laid out side by side or that can be grouped in a variety of shapes or matrices. In one embodiment, at least some of the electrical contacts provide a electrical connection with the interfacing connector of the hand held electronic device. The number of contacts may also be widely varied and typically depends on the needs of the system. In one embodiment, the connector is a connector with at least 30 pins, and more specifically at least pins that are laid out side by side thus providing a substantially low profile planar connector.

The electrical connection between the attachment end of the connector and the electronics inside the docking station may be widely varied. In one embodiment, the connection is made via a set of wires or traces. The wires may run through the pivot point or through a slot in the connector bay in order to get inside the housing. In one embodiment, the connection is made via a flex circuit that may also run through a slot in the connector bay in order to get inside the housing. In one embodiment, the connection is made via a series of swiping contacts.

In one example, the pivot arm may include a series of annular contacts spaced longitudinally about the arm that extends within the housing and contacts that interface with corresponding contacts of the pivot arm. The dock 100 may include a print circuit board (PCB) inside the housing. In one aspect, the PCB may be electrically connected with any number of contacts of the connector 130. The connection between the contacts and the PCB will be described in greater detail below.

In one embodiment, the PCB is connected with one or more secondary connectors 140, which may be on any accessible surface of the housing 110. In one aspect, the secondary connectors provide an electrical connection to the hand-media player via the connector 130 and the PCB. A secondary connector 140 may be, for example, a USB, Firewire (or other data connector), composite video or other video connector, audio headphone jack, digital audio connector, or other audio connector, which may allow a connection to another electronic device. For example, the audio jack may be used to connect the media player to an amplifier and speakers.

Besides secondary connectors 140, the dock 100 may have electronic devices built into the dock. For example, the dock 110 may have speakers 150 that play music. Another example is a screen for showing picture or video (e.g. a screen that is bigger than one that may be found on the media player).

In one embodiment, once or as the connector 130 is put or being put into the closed position, an operation of the docking station 100 is turned off. For example, at some point in the movement from an open position to a closed position, power is turned off. The point at which the power is turned off may be when the connector 130 is secured by mechanisms mentioned herein or by a switch that is activated by the motion past a certain point. The power may be received from a battery or from a wall outlet, but after being turned off, the power level drawn becomes zero or severely reduced.

The connector can have multiple methods of actuation, such as a pull out/push back, or a button that allows the connector to deploy/retract automatically. For example, a button could be depressed, causing the connector to rotate out of the dock's main body. The connector could be returned to it's original position by pressing another button, or by pushing the connector back into the dock. In one embodiment, the connector may be hidden under one or more flappable doors (e.g. a pair) and in some cases may be attached to one of the flappable doors. In one aspect, a flappable door includes a pivot mechanism about which the connector 130 rotates.

In one embodiment, the connector may pop up from the connector bay 120. For instance, the connector bay 120 be vertical in position (as opposed to the horizontal position shown in FIG. 1A), and the connector 120 may pop up from the open end of the connector bay 120. In another embodiment, the connector may slide into the connector bay (e.g. from an interior wall), thus providing at least a temporary residence of the connector in the connector bay. The connector may also slide out from one of these ends of the connector bay 120.

FIGS. 3A-3D show side views of a docking station 200 having a connector 230 that rotates according to an embodiment of the present invention. The housing 210 includes a connector bay 220 in which the connector 230 resides. The connector 230 has an electrical connection 247 at a second end for connecting to the PCB 245. When a plurality of locations at a first end 243 of connector 230 have an electrical contact (pin), then connection 247 may have a separate connection for each of these contacts. Thus, each contact may be coupled with a wire, trace, or other connection that carries a signal to the PCB 245. In an embodiment where the connection 247 is a wire, the wire may be made with enough slack to accommodate movement of the connector 230.

A pivot mechanism 255 (pivot) provides for a rotation of the connector 230. In one embodiment, the pivot mechanism consists of an axle and a bearing within a hole in the connector. Each end of the pivot mechanism 255 may be fastened to the housing 210. In one embodiment, a flexible circuit board is used as the PCB 245 to accommodate the moving connector.

The rotation of the pivot 255 may pass 90 degrees (relative to the closed position—e.g. horizontal) to ensure proper force balance. For example, at a rotation of 105 degrees (e.g. counterclockwise), the weight of the media player acts rotate the connector 230 even more in the counterclockwise direction, thus preventing an accidental rotation to the closed position. A stopper, which may be the housing 110, may be used to stop further rotation past 105 degrees, or whatever degree is chosen as being a maximum value. Thus, as the degree is greater than 90 degrees, the connector cannot rotate more and position is retained. Accordingly, this may be termed a retention mechanism.

Figure 3C:
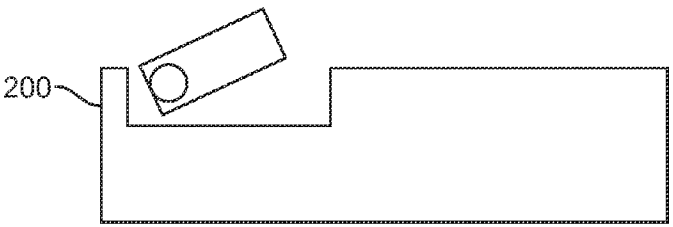
FIGS. 3A-3D show side views of a docking station 200 having a connector 230 that rotates according to an embodiment of the present invention.
Figure 3D:
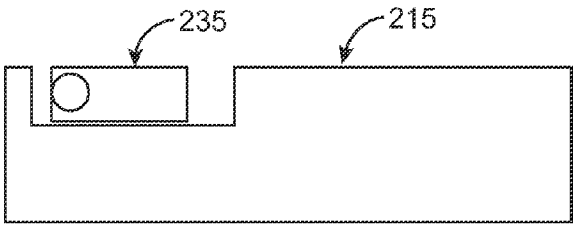
Figure 3A:
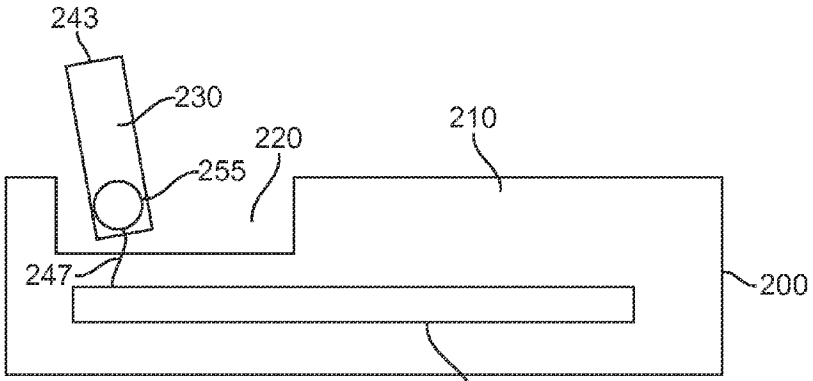
Figure 3B:
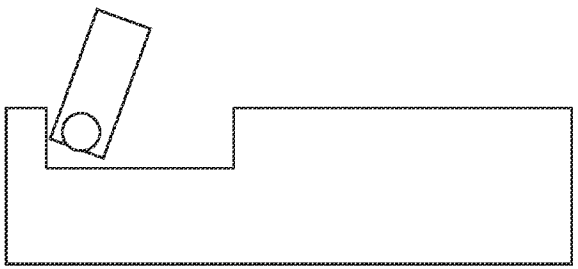

FIG. 3B shows the connector 230 in a different open position. The different open positions may be used depending on the viewing angle and direction of the user. For example, the angle used in FIG. 3A may be used when the consumer is on the right of the dock 200. For the angle used in FIG. 3B, the user may be to the left of the dock 200. A different retention mechanism may be used to keep the connector in this open position compared to the retention mechanism used for the open position of FIG. 3A.

FIG. 3C shows the connector in a non-retained position going towards a closed position. That is the connector 230 shown in FIG. 3C is in motion or a temporary position that is not retained (e.g. locked), although in other embodiments it may be retained. In embodiments where this position is not retained, the angle of the position of FIG. 3C generally would not be used by the consumer during operation of dock 200.

FIG. 3D shows the connector 230 in a closed position. In one embodiment, in the closed position, a side 235 of the connector plug is substantially flush or below a top surface 215 of the housing 210. Thus, the surface 215, including the connector bay, is substantially flat, which, for example, allows objects to be securely placed onto the surface 215 and/or allows the dock 200 to be conveniently placed in storage (e.g. a pocket or bag).

In one embodiment, the connector 230 may slide, in addition or in alternative, to the rotation. The connector may slide out into the connector bay (which provides for a residing of the connector 230 in the connector bay), and then the rotation may be actuated. Alternatively, the connector could translate vertically out of the dock.

The connection to the PCB 245 may occur in any number of suitable ways. Below are a few examples.

FIGS. 4A-4D is a cross-sectional view of a docking station showing electrical connections of a PCB to the connector 230 according to an embodiment of the present invention. The connections may be made via any conductive materials, e.g. copper, gold, metallic alloys, etc. In one aspect, the contacts at the first end (e.g. end 133 that is not shown here), which connects with the media player, are electrically coupled with a conductive element (e.g. 365*a*-365*d*) that travels from a point of contact on the connector assembly 230 to the PCB board. The point of contact on the connector assembly 230 may occur at any point on the connector 230. In one embodiment, the point of contact is made at electrical contacts at the second end (i.e. nearest the PCB 245), where these second electrical contacts are electrically coupled with the contacts at the first end that are configured to connect to the media player.

Figure 4A:
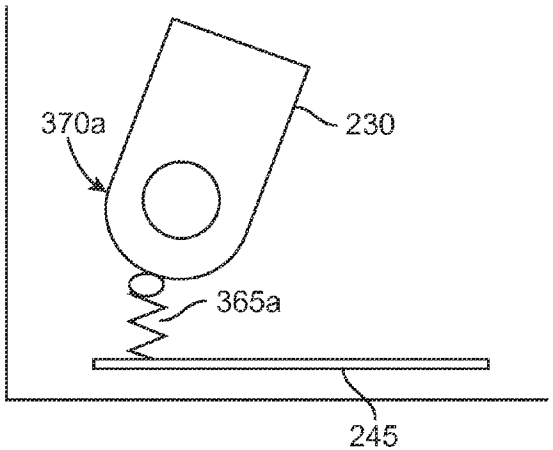
FIGS. 4A-4D is a cross-sectional view of a docking station showing electrical connections of a PCB to the connector 230 according to an embodiment of the present invention.

In FIG. 4A, connector 230 has a plurality of second contacts 370 (such as conductive traces, wires, plates, or other such elements) at the second end of the connector. There may be a one to one correspondence with each first contact that appears at the other end of the connector 230. For example, the second contacts 370 may be multiple parallel strips.

In one aspect, a conductive element 365*a* stays in contact with the second contacts 370 as the connector moves since the contacts 370 are long. As the connector moves, different parts of the contacts 370 will be touching the element 365*a* so an electrical connection may be maintained. In one embodiment, the conductive element 365*a* includes a spring to ensure that a stable connection is always made with the second contacts 370. This may be particularly useful when the contacts 370 do not form a semi-circle and thus may be different distances from the axis of rotation of the connector 230. The second contacts 370 may be considered swiping contacts in that the contacts swipe by the conductive element 365*a*.

Figure 4B:
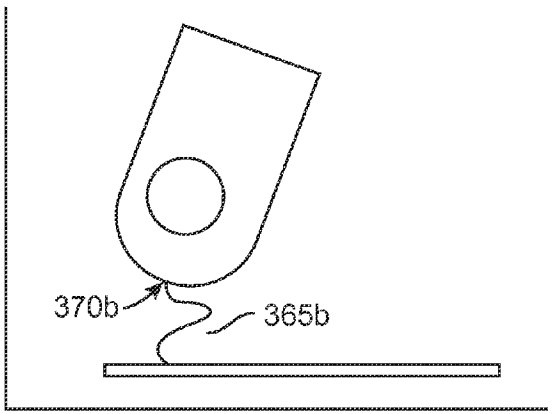

In FIG. 4B, a wire 365*b* or multiple wires are connected to respective second contacts 370*b*. In one aspect, a wire 365*b* is fixed to a particular point on a contact 370*b*. However, there exists enough slack on the wire 365*b* that the connection continues regardless of the position of the connector 230.

Figure 4C:
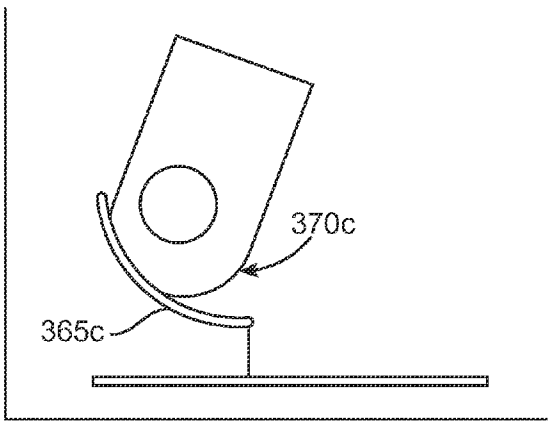

In FIG. 4C, the conductive element 365*c* has long strips, e.g., one for each corresponding first contact. In this embodiment, the second contacts 370*c* may have long strips or may be a single point contact. As the connector 230 moves, at least one part of the second contacts 370C stays connected with the conductive element 365*c*. The conductive element 365*c* may reside on a support (not shown). The curved part of the conductive element 365*c* can be connected directly to the PCB 245 or have an additional segment that connects to the PCB 245. The conductive element 365*c* may be considered swiping contacts in that they are swiped by the second contacts 370*c*.

Figure 4D:
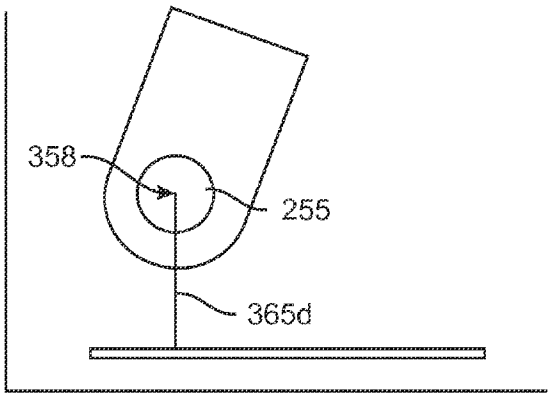

In FIG. 4D, the conductive element 365*d* couples with a part of the connector assembly 230 that does not move up or down. For instance, the axis 358 of the pivot mechanism 255 does not move when the connector rotates. In embodiments connected to parts that do move correspond to the embodiment of FIG. 4A. Again, a different wire, trace, or other element may be used for each first contact at the front (first) end of the connector. Note that the wires 365*d* may be bundled into a single outer casing. Also, a portion of the wires (e.g. half) could come from one end (shown) of the connector, and the remaining portion from the opposite end (not shown).

Once the connector 230 is in an open position, the media player may be connected with the connector 230, thus allowing a desired operation angle (e.g. for proper viewing and operation of the controls). Once the media player is connected, it is often desirable to have the connector stay in the present open position, e.g., for continued operation. Thus, embodiments provide for a retention mechanism to hold the connector in position when connected with the media player.

The number of open positions for the connector 230 may be continuous. In other words, the connector is not locked into particular positions. However, embodiments still have a retention mechanism to hold the connector in a selected position when connected with the media player. Other embodiments have a discrete number of positions.

Figure 5A:
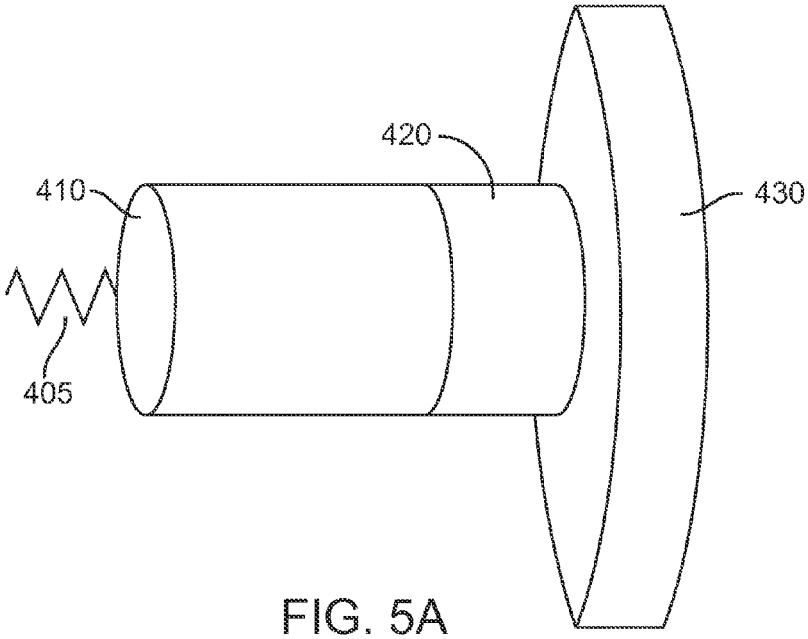
FIG. 5A shows a retention mechanism 420 for continuous open positions of the connector according to an embodiment of the present invention.

FIG. 5A shows a retention mechanism 420 for continuous open positions of the connector according to an embodiment of the present invention. Here, the retention mechanism 420 is a device that presses against the pivot 410, thus causing a retention force. In other words, there is enough friction that the weight of the media player, by itself, would not cause a movement of the connector. However, the force may be overcome by pushing or pulling the connector, particularly when the fulcrum is large, such as when the media player is connected with the connector.

In one embodiment, the retention mechanism is directly attached to the pivot 410 and moves in relation to a wall 430, which may be a wall of the housing 110. In another embodiment, the retention mechanism may be attached to the wall 430 and the seam between the pivot 410 and the retention mechanism may be where the movement occurs. The retention mechanism may be larger or smaller than the diameter of the pivot 410. Such a mechanism may wear out, and thus other mechanism that engage and disengage may be optimal for continuous open positions.

In yet another embodiment, a compression spring 405 provides a force to keep the pivot 410 pressed against the retention mechanism 420. The spring may be compressed by a user, thus relieving the force and allowing more freedom (e.g. less friction) of movement to the pivot 410.

Figure 5B:
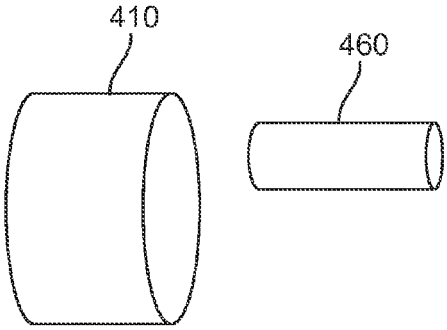
FIGS. 5B and 5C shows a retention mechanism 460 that disengages for continuous open positions of the connector according to an embodiment of the present invention.
Figure 5C:
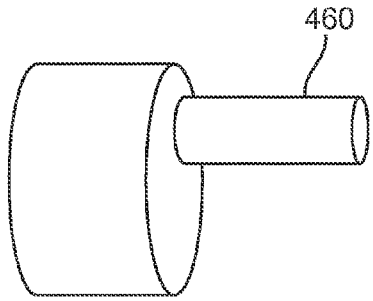

FIGS. 5B and 5C shows a retention mechanism 460 that disengages for continuous open positions of the connector according to an embodiment of the present invention. In FIG. 5B, the retention mechanism 460 is disengaged (released) from the pivot 410. Thus, the pivot 410 is allowed to rotated relatively freely, i.e. with the minimal friction. The retention mechanism also may be of any suitable size, such as the diameter of the pivot 410. Note that as the pivot 410 may be stopped in any position, the number of open positions is continuous, and not discrete.

In FIG. 5C, the retention mechanism 460 engages the pivot 410 and acts as a clamp to restrict rotation of the pivot 410. The restriction of movement may be obtained through the friction of the clamp pressing against the pivot 410. The motion of the retention mechanism 460 may be actuated by a button or lever, as described herein.

In other embodiments, the number of open positions for the connector 230 are not continuous, but discrete. In other words, the connector is locked into particular positions.

Figure 6A:
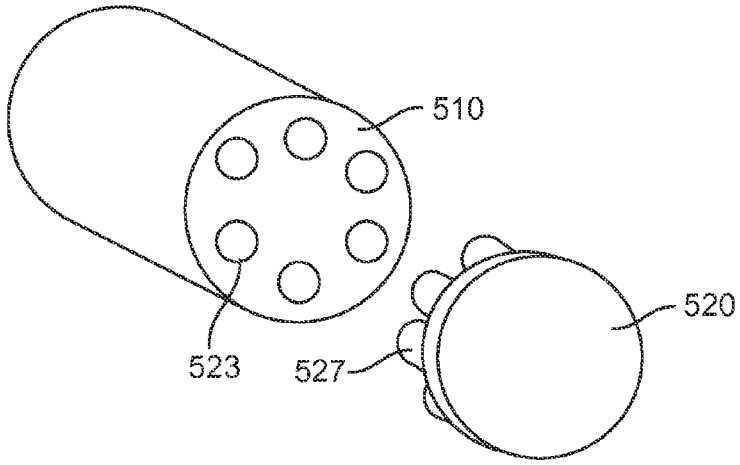
FIG. 6A shows a retention mechanism 520 for discrete open positions of the connector according to an embodiment of the present invention.

FIG. 6A shows a retention mechanism 520 for discrete open positions of the connector according to an embodiment of the present invention. A pivot mechanism 510 may be attached to the connector 230 as shown in FIGS. 3A-3D, as is pivot mechanism 255. In one embodiment, an additional support (axis) rod may be placed through the pivot mechanism 510 and the retention mechanism 520.

As shown, the retention mechanism 520 is shown not engaged with the pivot mechanism 51 0. In this configuration, the pivot mechanism may rotate and/or allow rotation of the connector 230 to which it is coupled. The retention mechanism 520 has any number of fingers 527 that fit into a corresponding number of holes 523. Once the retention mechanism 520 engages the pivot mechanism 510, the fingers 527 will fit into the holes 523, thus preventing rotation. Note that the retention mechanism 520 is fixed, at least temporarily when the rotation is prevented. For example, the retention mechanism may be fixed to part of the housing 110 of the dock 100 so that the rotation is prevented. As the retention mechanism may engage and disengage, the retention mechanism 520 may be termed a releasable locking mechanism.

The retention mechanism 520 may be moved into and out of engagement with the pivot mechanism in any number of suitable ways. The retention mechanism 520 could be directly grabbed or pulled away. A lever could be activated to pry the retention mechanism apart, which could be by pulling on the retention mechanism 520 or pushing the pivot mechanism 510. Each or both could be coupled with a spring which acts to cause engagement after the pivot 510 is rotated to the desired position. In one aspect, the push or the pull is activated by a button on the housing 110, thus causing the separation.

In another embodiment, the connector and/or the pivot 510 moves laterally supported by a spring. For example, the matching parts of the rotatable hub of the pivot mechanism 510 and of the frame (i.e. retention mechanism 520) lock the connector in its current place. When the connector is laterally moved and the parts of the hub become disengaged, then the connector can be opened or closed. The spring acts to bring the matching parts back into engagement.

Figure 6B:
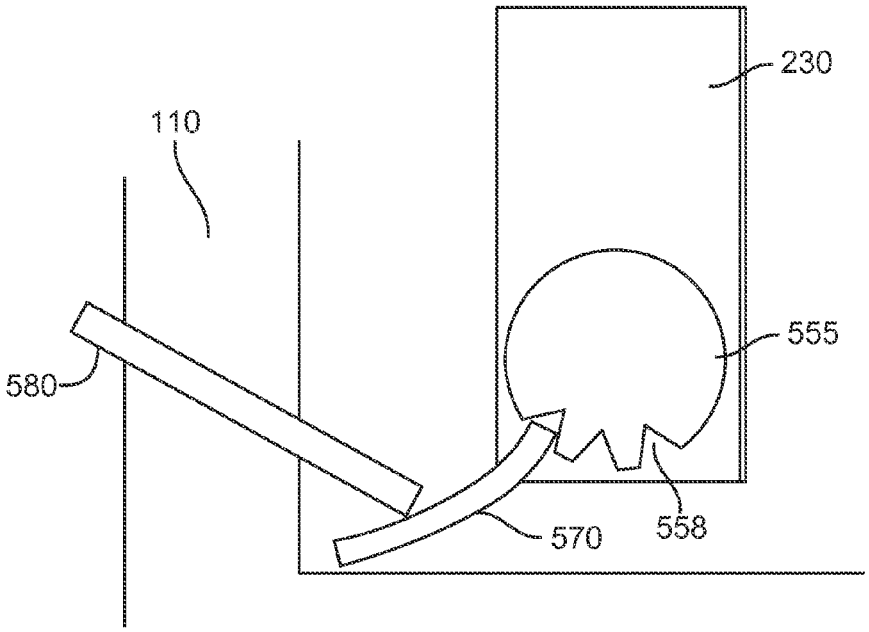
FIG. 6B shows a retention mechanism 570 for discrete open positions of the connector according to another embodiment of the present invention.

FIG. 6B shows a retention mechanism 570 for discrete open positions of the connector according to another embodiment of the present invention. Here, a follower 570 is used to hold the connector in position, thus providing a ratchet mechanism. As shown, the follower 570 is shown engaged with the pivot mechanism 555 by fitting into divots (teeth) 558 in the pivot 555. In this configuration (i.e. position), the pivot mechanism 555 may not rotate and/or allow rotation of the connector 230 to which it is coupled.

In order to release the follower 570, a lever 580 may be used to depress the follower 570 to disengage the follower 570 from the pivot 555. The lever 580 may be accessed from outside the housing 110 by pressing on the lever 580. Once, the lever (button) is pressed, the connector 230 may be rotated. In one embodiment, the follower 570 may be or include a spring.

In one aspect, the connector is pulled open (from the closed position) until the ratchet teeth 558 engage the locking spring, which locks the connector in the open position. The unlock button 580 can be used to push the locking spring 570 out of the ratchet teeth so as to allow the connector to be pushed down into the closed position.

The retention mechanisms may be referred to as detents. In one embodiment, magnetic detents may be used to secure the connector 230 in specific open positions. U.S. patent application Ser. No. 11/759,499 entitled "Multi-Position Magnetic Detents", by Christopher D. Prest, filed Jun. 7, 2007 provides a description of magnetic detents usable in the present invention. These magnetic detents may thus be used to secure the connector 230 when connected with the media player. In some embodiments, actuations elements (such as buttons) may be used to disengage the magnetic detents. In other embodiments, where disengagement is not performed, the magnetic detents allow rotation when a large force (such as by one's hand) is used.

Figure 7A:
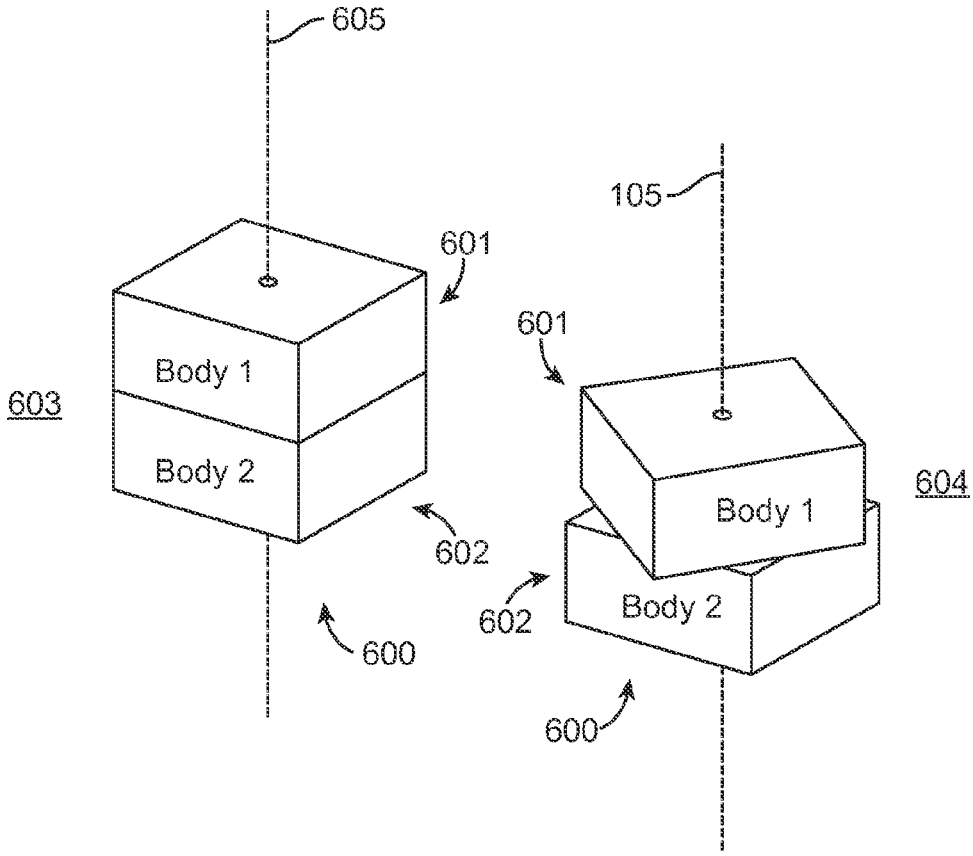
FIG. 7A illustrates a magnetic detent according to an embodiment of the present invention.

FIG. 7A illustrates a magnetic detent according to an embodiment of the present invention. Depicted in FIG. 7A is detent 600 comprising a first body 601 and second body 602. In this example, first detent body 601 and second detent body 602 are adapted to rotate about a common axis of rotation 605. FIG. 7A depicts detent 600 in two detent positions 603 and 604. When detent bodies 601 and 602 are in one of the two detent positions, they are in a configuration of relative stability with respect to each other.

Figure 7B:
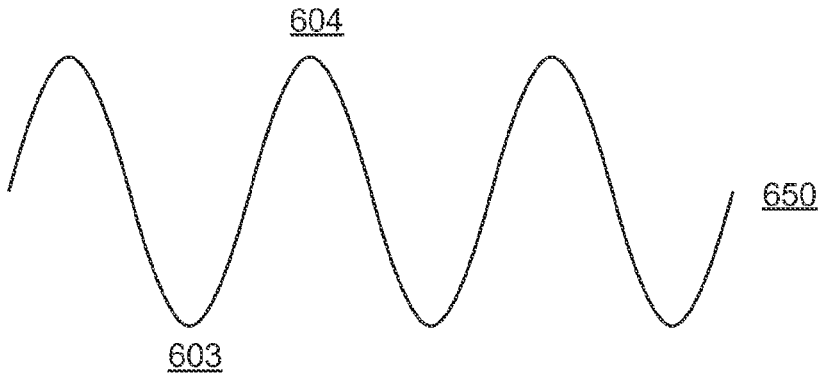
FIG. 7B shows a resulting magnetic force profile according to an embodiment of the present invention.

FIG. 7B shows a resulting magnetic force (energy) profile for the positions 603 and 604 according to an embodiment of the present invention. As one can see, the position 603 is at an energy minimum, and the position 604 is at an energy maximum. By energetic principles, energetic minimums are favored, and objects typically will fall naturally into the energy minimums. In one embodiment, each trough is an open position.

Depending on the strength of magnetic forces holding detent body 601 and detent body 602 in a detent position, a small perturbation of an external force on either bodies may not move the detent bodies out of a detent position (e.g. position 603). If a small enough force is applied, a self-aligning force will arise to move the detent bodies 601 and 602 back to the initial detent position (e.g. position 603).

A larger perturbation of an external force on either body may however overcome the self-aligning force to move the bodies out of the initial detent position (e.g. 603) and into another position (e.g. 604). In the example shown in FIG. 7A, if detent positions 603 and 604 are the only detent positions provided by detent 600, an application of a large external force will move the detent bodies successively between detent positions 603 and 604. Note that the two bodies may have more corners than four (e.g. star shaped), and thus the force profile will have more than four energy minimums (i.e. open positions).

As mentioned above, U.S. patent application Ser. No. 11/759,499 provides additional embodiments for the magnetic detents. Also, in one embodiment, the closed position may be at an energy minimum of the force profile. In another embodiment, the closed position is not at an energy minimum (e.g. an energy maximum), where a locking mechanism retains the connector in the closed position. In yet another embodiment, the magnetic detents (or even the force profile itself) may not be reached until the connector is in an open position. For example, the two bodies may not be near each other (or couple to the connector) until an open position is reached.

Force profiles may be generated in other ways besides using magnetic forces. For example, mechanical (including gravitational forces) may be used.

Figure 8A:
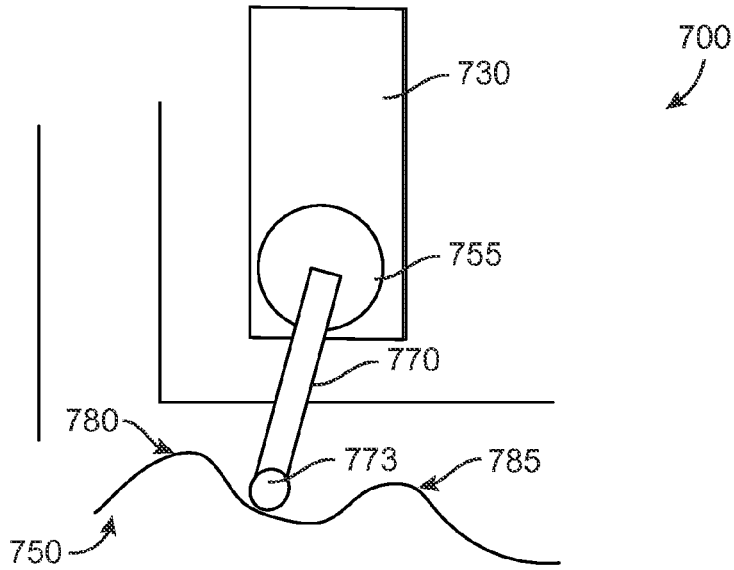
FIGS. 8A-8C shows a connector assembly 700 with a force profile according to an embodiment of the present invention.
Figure 8B:
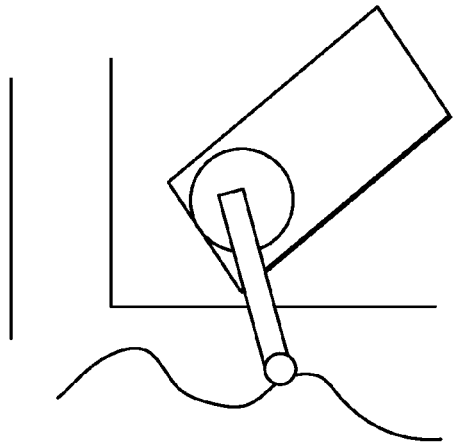
Figure 8C:
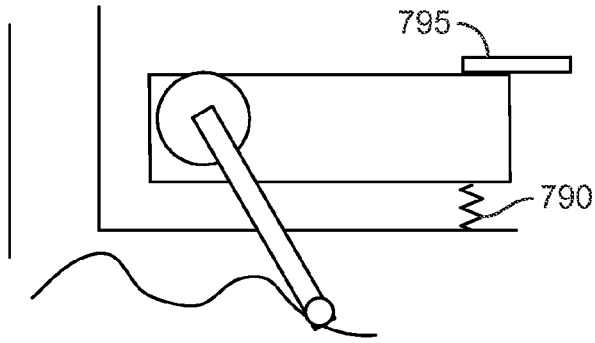

FIGS. 8A-8C shows a connector assembly 700 with a force profile according to an embodiment of the present invention. The connector 730 rotates via a pivot mechanism 755. A force element 770 is connected to the connector 730, e.g., at the pivot 755. In one embodiment, the force element 770 is or includes a spring. At the opposite end, the force element 770 includes a rolling mechanism 773 (e.g. a ball or cylinder) that moves along a contour surface 750. This surface provides the force profile for the movement of the connector 730.

In FIG. 8A, the force element 770 is positioned along a point of relative stability (energy minimum) of the contour surface 750. For example, the contour 750 has a surface that increase in height from the point shown for the roller 773. Thus energy (force) must be imparted to move the connector from the present position, thus stability is provided, and an open position is maintained. When the media player is connected with the connector 730, the connector may move some, but not enough to overcome the peaks 780 or 785.

In one embodiment, the spring 770 glides along the contour 750 (e.g. an undulated surface) in the bottom of the frame (housing). As the connector is rotated about the pivot point (e.g. part of the pivot mechanism 755), the spring 770 contacts different parts of the In FIG. 8B, the connector 730 has been moved toward the closed position. Due to the peak 785, a force must be imparted onto the connector, e.g., by a consumer's hand. Accordingly, the connector does not close when the media player is connected to the connector 730. The peak 785 should be high enough to prevent such an accidental closing, but low enough to allow for a manageable closing action.

In FIG. 8C, the connector 730 is shown in the closed position. As shown, the closed position puts the rolling mechanism 773 below the peak 785. Thus, toward the end of the closing process, the slope on the back end of the peal 785 assists in the closing of the connector 730. Note that other peaks may be provided so that multiple open positions may be obtained.

In one embodiment, a spring 790 provides a force to overcome the peak 785 in the opening process, i.e. a traverse of the roller 773 over the peak 785 coming from the left. A latch 795 may be used to keep the connector 730 in the closed position. When the latch 795 is disengaged from the connector 730, the spring 790 would then push the connector over a first peak 785. The latch may be configured in many different ways as would be known to one skilled in the art. In one embodiment, the connector may include a cantilever press button that is or is coupled with the latch. In another embodiment, a second spring or force dampener is coupled with the force element 770 and is used to resist or aid in the opening/closing of the connector.

A spring may be used with other retention mechanism as well. For example, a force profile may have a single minimum.

Figure 9:
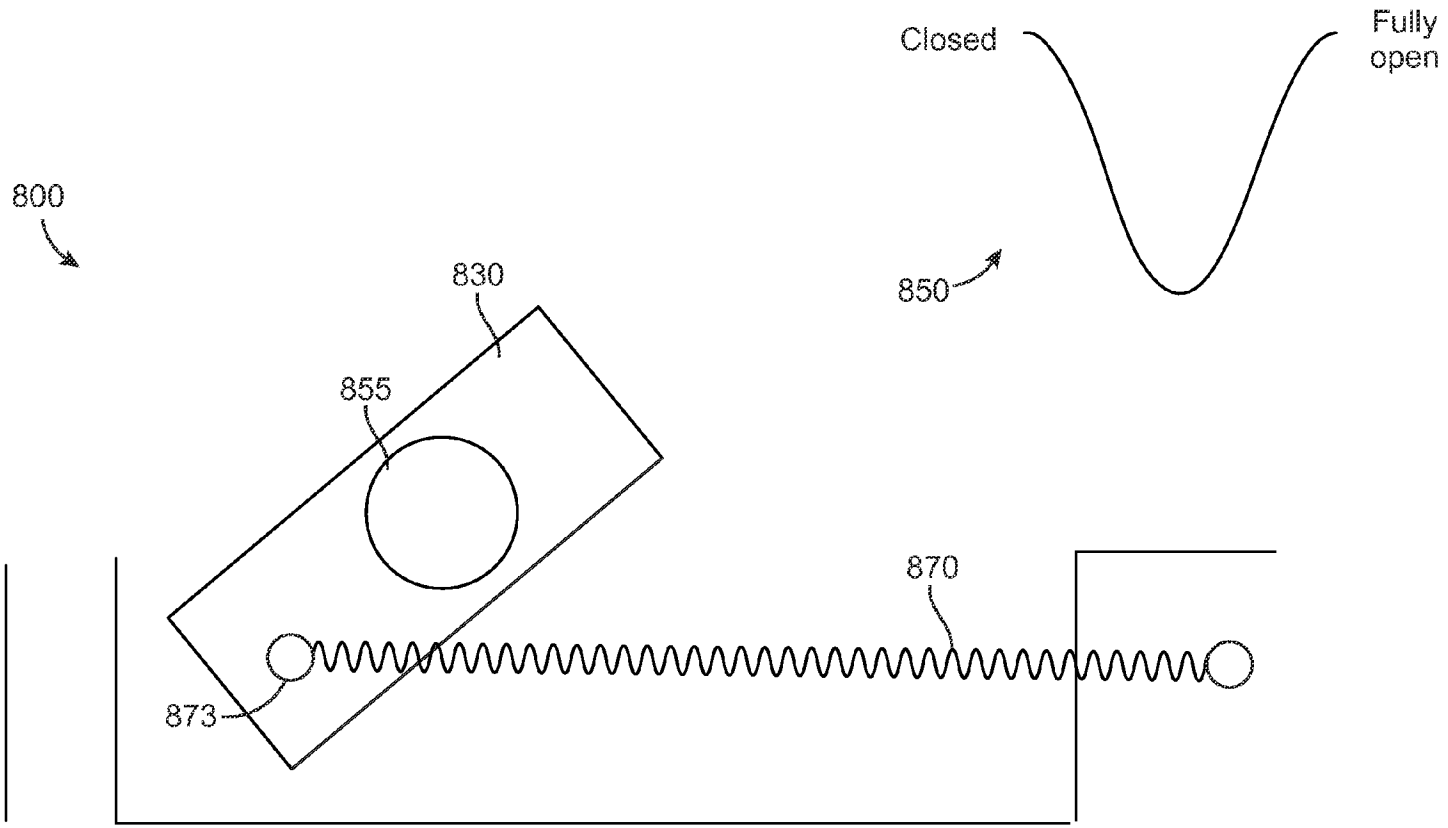
FIG. 9 shows a connector assembly 800 having a spring that provides a force profile according to an embodiment of the present invention.

FIG. 9 shows a connector assembly 800 having a spring that provides a force profile according to an embodiment of the present invention. A spring 870 provides a force profile 850 between a closed position and a fully open position. As shown the force profile is symmetrical between these two positions; however, note that the force profile 850 may be non-symmetrical. The force from the spring 870 brings the connector 830 to the bottom part of the force profile 850. The closed position is depicted on the left as that is the relative position of the end 873 of the spring 870.

Starting from the closed position, the spring 870 would pull the bottom end 873 of the spring (and the thus that end of the connector 830) to the right. As depicted, this pull from the spring 870 provides a counterclockwise rotation of the connector 830. This pull also assists in the placing of the connector 830 in an open position. A latch may be used similarly as in FIG. 8C to keep the connector 830 in a closed position.

In one embodiment, in the open position, the connector 830 can be opened past 90 degrees so that stays open under the weight of the attached media player. The gravitational force of the media player is larger than the restorative force of the spring to reach the energy minimum, which, for example, may be at 90 degrees.

In one embodiment, the spring 870 may be anchored to the housing on the left side of the connector 870. In this embodiment, the spring may act to pull the connector closed. Again, the weight of the media player may be used to keep the connector 830 in place. A push button may release the connector from its open position, at which time the spring pulls the connector back into the frame such that it lies flat.

In any of the embodiments, the spring 870 may be in the pivot mechanism 855 as opposed to the longitudinal configuration as shown. In one embodiment, the pivot mechanism has two pieces, where the inside piece is connected to the spring, and the outside connector piece is rotatable relative to the inside piece to an open position.

As there is a single and rather wide minimum in the force profile 850, the connector may not be positioned accurately to the liking of a consumer by just using the spring. Also, multiple open positions may be desired. Thus, in one embodiment, a retention mechanism such as that of FIGS. 5-7 may be used with the spring 870 of FIG. 9.

In another embodiment, a dampening spring hinge may be used. Also, besides pivot mechanisms where the connector rotates around an axis of rotation, other pivot mechanisms may be used.

Figure 10A:
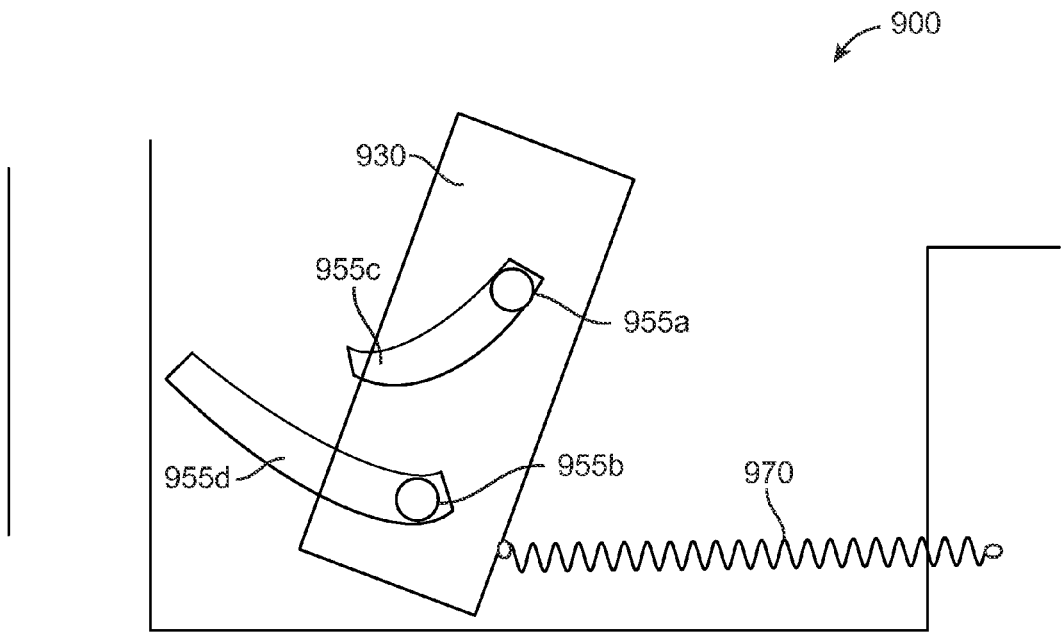
FIG. 10A-10B show a connector assembly 900 with a pivot mechanism 955 according to an embodiment of the present invention.
Figure 10B:
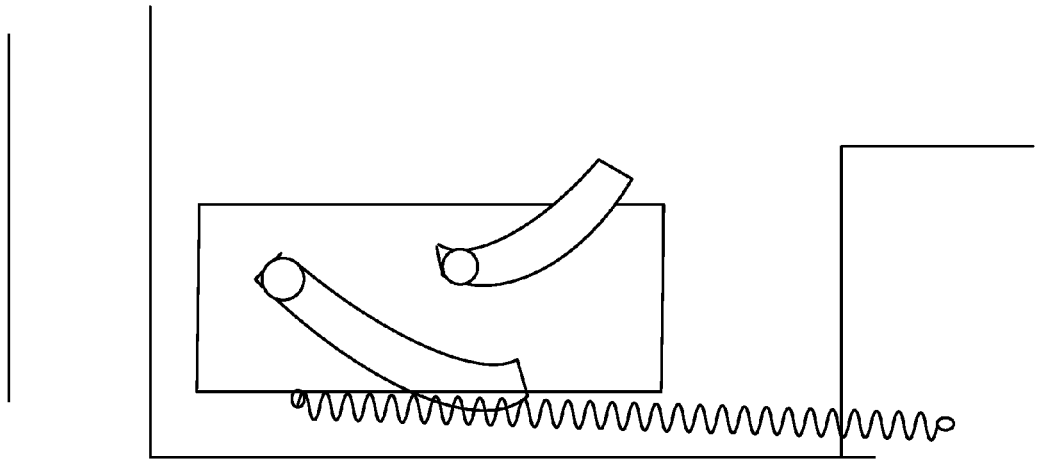

FIG. 10A-10B show a connector assembly 900 with a pivot mechanism 955 according to an embodiment of the present invention. The pivot mechanism 955 includes two pegs 955*a*, 955*b* on a side of the connector 930. The other side of the connector 930 may also have identical pegs. The pivot mechanism 955 also includes two slots 955*c*, 955*d* that the pegs 955*a*, 955*n* respectively fit into. Note that in other embodiments one peg may be used, or additional pegs may be used.

FIG. 10A shows the connector 930 in an open position. In one embodiment, the spring 970 pulls the connector 930 into the open position because the equilibrium position for the spring 970 is close to the length achieved when the in the open position. Thus, the spring 970 will retain the connector 930 in the open position. Here, the spring force counteracts the weight of the media player 930, which would make the connector 930 rotate clockwise.

FIG. 10B shows the connector 930 in the closed position. The pegs 955*a-b* have respectively slid through the slots 955*c-d* and reside at an opposite end of the slots. In one embodiment, the spring 970 is stretched past its equilibrium in the closed position. Thus, a latch mechanism may be used to keep the connector 930 in the closed position for this embodiment.

In other embodiments, the connector 930 may be held in position by clamping or otherwise locking the legs 955*a*, 955*b*. In one embodiment, the respective ends may have a small entrance so that the pegs lock into place once a force is imparted to squeeze the pegs through the entrance. In another embodiment, an actuated element may be moved into and out of position to block movement of the pegs in the slots.

The specific details of the specific aspects of the present invention may be combined in any suitable manner without departing from the spirit and scope of embodiments of the invention. However, other embodiments of the invention may be directed to specific embodiments relating to each individual aspects, or specific combinations of these individual aspects.

Moreover, the invention may also provide other features of docking stations as described in co-pending U.S. patent application Ser. No. 10/423,490 entitled "Media Player System" by Fadell et al; Ser. No. 11/212,302 entitled "Docking Station for Hand Held Electronic Devices" by Crooijmans et al.; and Ser. No. 11/125,883 entitled "Universal Docking Station for Hand-Held Electronic Devices" by Howarth et al., which are herein incorporated by reference.

The above description of exemplary embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated.

What is claimed is:

1. A docking station for receiving a hand-held electronic device, the hand-held electronic device having a receptacle connector, the docking station comprising:

a housing;

a connector bay formed in the housing; and a connector assembly that is configured to reside in the connector bay and that includes a connector plug configured to connect to the receptacle connector of the hand-held electronic device, and wherein the connector plug is movable between a closed position in which the connector plug is entirely disposed within the connector bay and at least one open position in which an end of the connector plug is exposed for coupling with the receptacle connector, wherein a first force profile for moving the connector plug from the at least one open position to the closed position includes a maximum between the at least one open position and the closed position.

2. The docking station of claim 1, wherein the connector plug has electrical contacts at a first end for connecting with the receptacle connector of the hand-held electronic device, further comprising:

a circuit board electrically coupled with the electrical contacts of the connector plug.

3. The docking station of claim 1, further comprising a retention mechanism configured to hold the connector plug in the at least one open position when connected with the hand-held electronic device, wherein the at least one open position occurs at an angle greater than 90 degrees relative to the closed position, and wherein the retention mechanism includes a stopper that prevents the connector plug from rotating further when the electronic device is connected with the connector plug.

4. The docking station of claim 1, further comprising a retention mechanism configured to hold the connector plug in the at least one open position when connected with the hand-held electronic device, and wherein the retention mechanism includes a releasable locking mechanism that is associated with each open position and that holds the connector plug in a respective open position when the locking mechanism is in an unreleased state.

5. The docking station of claim 4, wherein the number of open positions of the connector plug is continuous.

6. The docking station of claim 4, wherein the releasable locking mechanism includes a ratchet that is releasable via an element accessible on the housing.

7. The docking station of claim 4, further comprising a pivot mechanism coupled with the connector plug, wherein the releasable locking mechanism includes an element with fingers that lock into holes of the pivot mechanism during an unreleased state.

8. The docking station of claim 1, further comprising a pivot mechanism coupled with the connector plug, wherein the pivot mechanism includes at least one peg on a side of the connector plug and at least one corresponding slot through which the at least one peg slides during a rotation of the connector plug.

9. The docking station of claim 1, wherein the first force profile is created by magnetic detents.

10. The docking station of claim 1, wherein the first force profile is at a minimum in the at least one open position.

11. The docking station of claim 10, wherein the first force profile is at a minimum in each open position.

12. A docking station as in claim 1, wherein the connector plug moves between an open position and the closed position via one or more rotations and/or translations.

13. The docking station of claim 1, further comprising:

a spring that biases the connector plug toward the closed position or the at least one open position.

14. The docking station of claim 13, further comprising a latch that locks the connector plug into the closed position or the at least one open position.

15. The docking station of claim 1, further comprising a switch coupled to the connector plug, wherein the switch is activated when the connector plug is in the closed position.

16. A docking station for receiving a hand-held electronic device, the hand-held electronic device having a receptacle connector, the docking station comprising:

a housing;

a connector bay formed in the housing;

a connector assembly that is adapted to reside in the connector bay and that includes a connector plug adapted to connect to the receptacle connector of the hand-held electronic device; and a force element that includes a rolling mechanism coupled with the connector plug, wherein the rolling mechanism moves over an undulated surface when the connector plug rotates, wherein the connector plug is movable between a closed position in which the connector plug is entirely disposed within the connector bay and at least one open position in which an end of the connector plug is exposed for coupling with the receptacle connector, wherein a first force profile for moving the connector plug from an open position to the closed position includes an increase in the force profile.

* * * * *